US006975561B2

(12) United States Patent
Forsey et al.

(10) Patent No.: US 6,975,561 B2
(45) Date of Patent: Dec. 13, 2005

(54) CHRONOGRAPH MECHANISM

(75) Inventors: Stephen Edward Methuen Forsey, Le Locle (CH); Robert Greubel, La Neuveville (CH)

(73) Assignee: Vaucher Manufacture Fleurier S.A., Fleurier (CH)

( * ) Notice: Subject to any disclaimer, the term of this patent is extended or adjusted under 35 U.S.C. 154(b) by 0 days.

(21) Appl. No.: 10/511,453

(22) PCT Filed: Jun. 13, 2003

(86) PCT No.: PCT/IB03/02314

§ 371 (c)(1),
(2), (4) Date: Oct. 12, 2004

(87) PCT Pub. No.: WO03/107278

PCT Pub. Date: Dec. 24, 2003

(65) Prior Publication Data

US 2005/0174888 A1 Aug. 11, 2005

(30) Foreign Application Priority Data

Jun. 13, 2002 (EP) ..... 02103067

(51) Int. Cl.[7] ..... G04B 47/00

(52) U.S. Cl. ..... 368/10; 368/110; 368/96

(58) Field of Search ..... 368/10, 69–71, 368/96, 106, 110–113

(56) References Cited

U.S. PATENT DOCUMENTS

| | | | | |
|---|---|---|---|---|
| 4,464,060 | A * | 8/1984 | Schneider | 368/96 |
| 6,466,518 | B1 * | 10/2002 | Akahane et al. | 368/64 |
| 2001/0043512 | A1 * | 11/2001 | Igarashi et al. | 368/204 |
| 2004/0037169 | A1 * | 2/2004 | Fondin et al. | 368/96 |

FOREIGN PATENT DOCUMENTS

| | | |
|---|---|---|
| CH | 535 453 | 5/1973 |
| DE | 25 35 479 | 2/1977 |

* cited by examiner

*Primary Examiner*—Kamand Cuneo
*Assistant Examiner*—Thanh S. Phan
(74) *Attorney, Agent, or Firm*—McGlew and Tuttle, P.C.

(57) ABSTRACT

Chronograph mechanism including first (20, 22) and second (21, 23) measured time counters and control means (24) arranged so as to start to stop one or other of the counters and a switching device (25) arranged such that the actuation thereof causes the started counter to stop and the stopped counter to start.

6 Claims, 6 Drawing Sheets

60
24
64
61
64b
621d
622d
25
64c
622
621
64d
68a
26
68d
68
68c
65c
621c
65d
65b
65a
40
521a
522a
421
422
50
521b
522b
522
521
662
661
621b
622b

CHRONOGRAPH MECHANISM

The present invention relates to chronograph mechanisms, which allow measurement of a time counted from a given instant, controlled by an application of pressure on push-buttons.

A watch provided with such a mechanism is, for example, disclosed in the work entitled "Théorie d'horlogerie", Chs-A. Reymondin et al. ISBN 2-940025-10-X, page 232 and following. These watches generally include two push-buttons, one for assuring the starting and stopping of the counter measuring the measured time, the other for setting the counter to zero. This time is displayed by means of at least one hand, generally arranged at the centre of the movement and indicating the time in seconds.

These watches enable the duration of an event, which may or may not have interruptions, to be timed. For certain applications, for example for measuring the thinking time of chess players, it is necessary to use an ad hoc apparatus or to use two chronographs.

It is an object of the present invention to propose a chronograph mechanism for measuring the duration of two events occurring in an alternating process. This mechanism is intended to cooperate with a movement including:

- a frame for carrying the components of the movement,
- means for counting the current time, including an energy source, a time base and a going train.

It includes more particularly:

- means for counting measured times,
- coupling means, arranged for engaging and releasing the measured time counting means from the current time counting means, and
- means for actuating the coupling means.

According to the invention this mechanism is characterized in that:

- the means for counting measured times include first and second chronograph gear trains, each intended to carry a hand, which respectively assure the display of a first and a second measured time,
- the coupling means include first and second coupling clutches, for coupling the going train respectively to the first and the second chronograph gear trains,
- the actuating means include:
  - a control device arranged so as to engage or release one coupling clutch or the other, and
  - a switching device arranged such that actuation thereof causes the engaged coupling clutch to be released and the released coupling clutch to be engaged.

In order to allow counting from zero, the actuation means further include an initialisation device, arranged for controlling the zero resetting of the measured time counting means.

In order to prevent the proper working of the mechanism being disturbed or ruined by manipulations, its switching device includes a locking structure arranged such that it can only be actuated when one of the chronograph gear trains is coupled.

Moreover, the locking means cooperate with the actuation means, such that the initialisation means cannot be actuated when one of the chronograph gear trains is coupled.

Other advantages and features of the invention will appear from the following description, made with reference to the annexed drawing, in which.

In the following description, the position of the various components of the watch is, sometimes, defined with reference to the position occupied by an hour hand on the dial.

Figure 1:
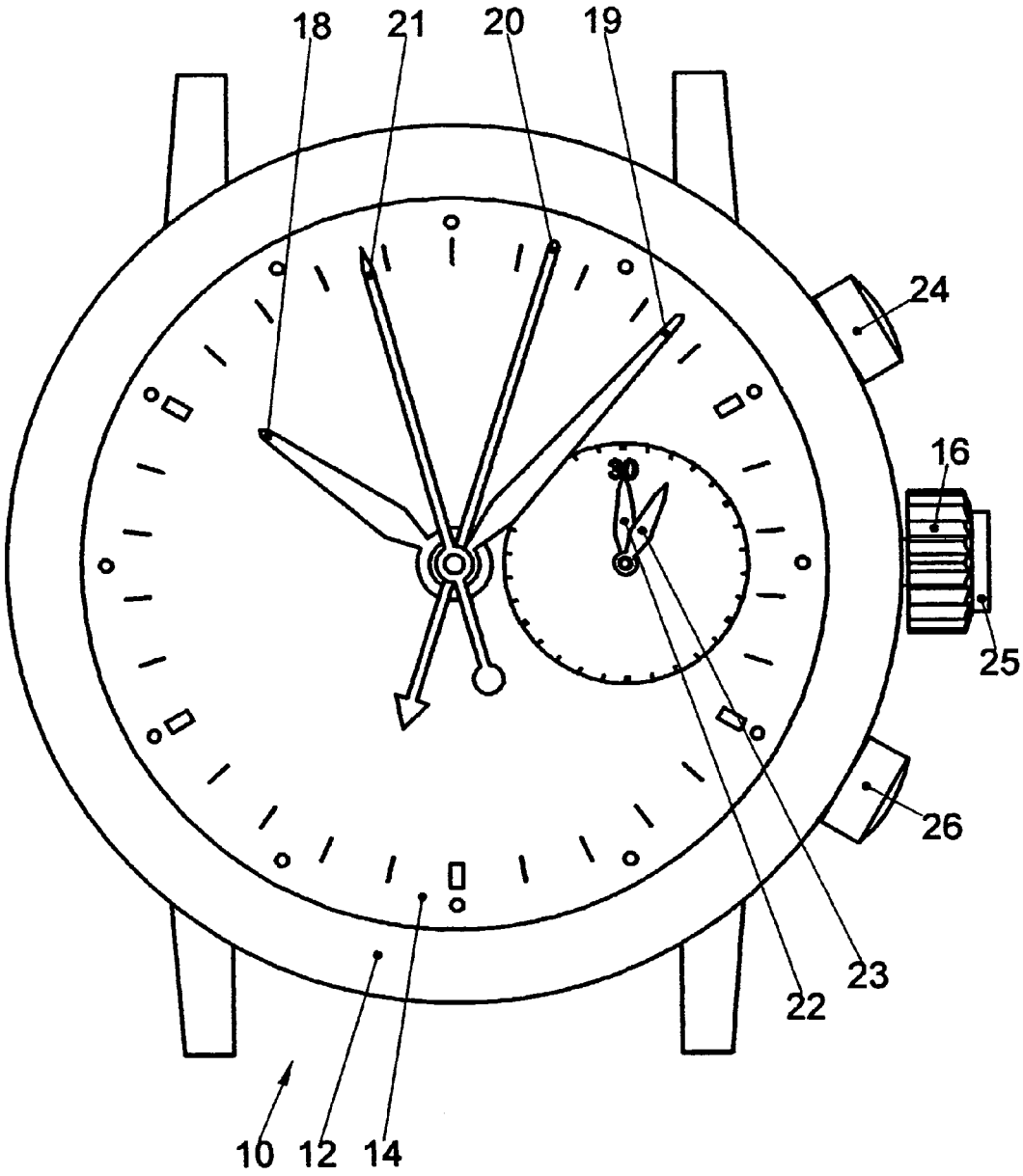
FIG. 1 shows a watch including a mechanism according to the invention.

FIG. 1 shows a watch 10, including a case 12, a dial 14, a winding and time-setting crown 16, five hands bearing the references 18 to 23 and three push-buttons, bearing the references 24 to 26.

In a conventional manner, case 12 contains and protects a movement including a mechanism allowing time to be measured, as will be explained hereinafter. It is closed by a glass, not visible in the drawing, which covers dial 14 and hands 18 to 23.

Hands 18 and 19 pivot at the centre of dial 14. They display respectively the hours and minutes of the current time. Hands 20 and 21 are arranged concentrically to hands 18 and 19. They are respectively driven by a first and a second counter and are for displaying the seconds of a first and a second measured time. Hands 22 and 23, which are off-centre and associated with a small unreferenced dial placed at three o'clock, display the minutes respectively of the first and second measured times. Hands 20 to 23 are thus means for displaying measured times.

Push-button 24, placed at two o'clock, controls either the start, or the stopping of the measurement of one or other of the two measured times, in accordance with a logic that will be described with reference to FIG. 2. Push-button 25, coaxial to crown 16, switches from counter to another, and push-button 26 resets hands 20 to 23 to zero.

Figure 2:
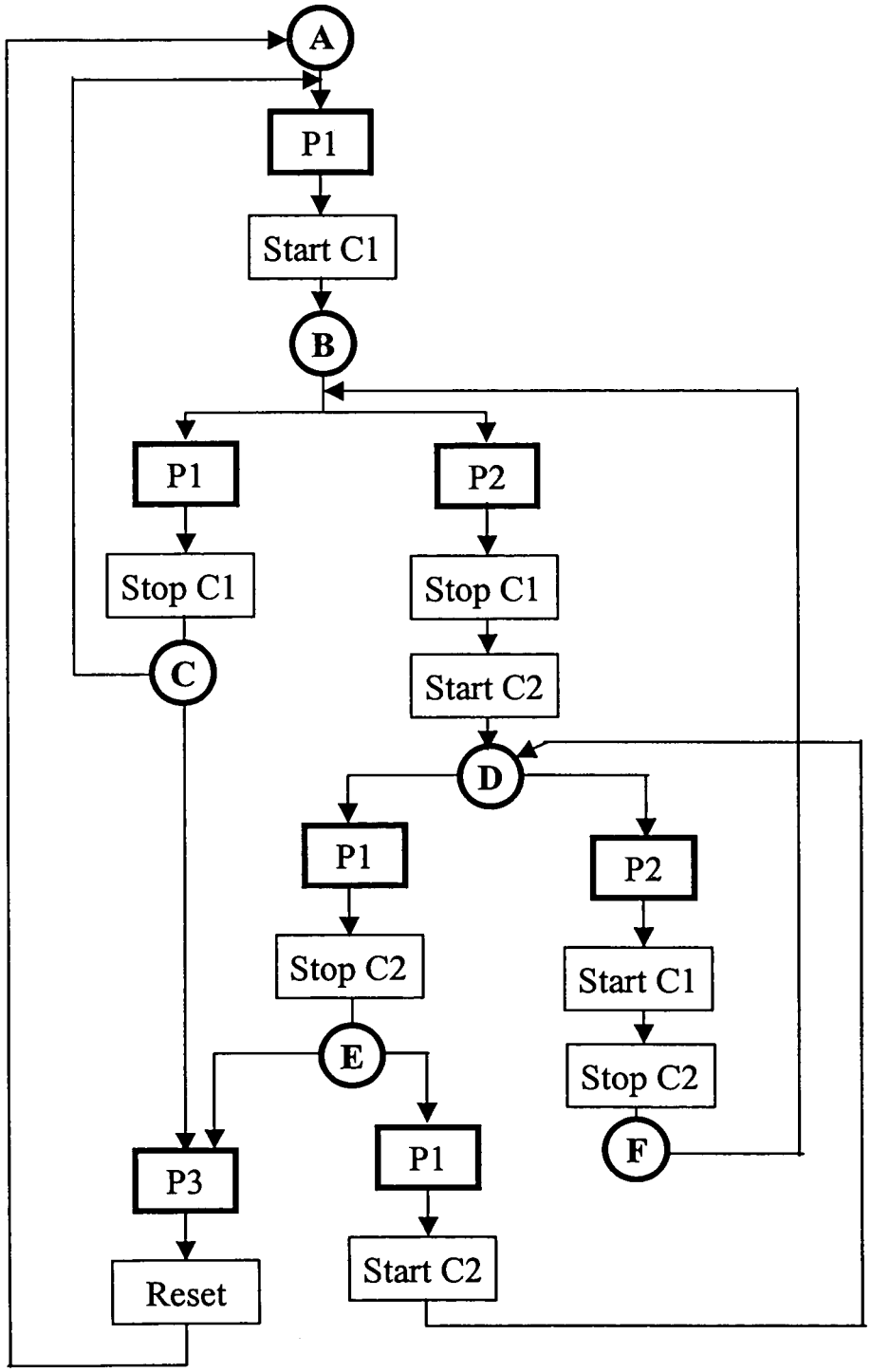
FIG. 2 shows an operating diagram of said watch.

In order to properly understand the operating principle of the mechanism according to the invention, FIG. 2 shows schematically the effect caused by an application of pressure onto one push-button or the other.

In this diagram, the push-buttons that are inactive in the various states that the mechanism can take have not been taken into consideration. Generally, it appears that push-button 24 can be actuated whatever the state of the mechanism. Push-button 25 is only active if one of the counters or the other is in operation, whereas push-button 26 can only carry out a zero reset when the first counter is stopped and the second counter is stopped or at zero.

In this Figure, the rectangles in bold print relate to actions P1, P2 and P3 carried out by the user of the watch respectively on push-buttons 24, 25 and 26.

The rectangles in thin lines indicate the changes brought about by the action concerned on the mechanism. In these rectangles, C1 and C2 identify respectively the first and second counters, Start, Stop and Reset, their start, stop and reset. The circles surrounding a capital letter define the various states in which the mechanism is found after the action, listed in the table hereinafter.

| State | First counter | Second counter |
|---|---|---|
| A | At zero | At zero |
| B | Counting | At zero |
| C | Stopped | At zero |
| D | Stopped | Counting |
| E | Stopped | Stopped |
| F | Counting | Stopped |

The watch is in state A when there is no time being measured, hands 20, 21, 22 and 23 being at zero. In this state, only one application of pressure P1 on push-button 24 is acting. It causes the first counter to start and hands 20 and 22 to start to move, hands 21 and 23 remaining at zero, which corresponds to state B of the mechanism. In this state, another application of pressure on push-button 24 (P1) has the effect of stopping the first counter, and consequently hands 20 and 22 indicating the measured time, which corresponds to state C of the mechanism. An application of pressure on push-button 25 (P2) is also possible. It causes the counters to switch, i.e. the first to stop and the second to start, the mechanism then being in state D.

When the mechanism is in state C, another application of pressure on push-button 24 (P1) causes the first counter to start again, bringing the mechanism to state B, whereas an application of pressure on push-button 26 (P3) causes hands 20 and 22 to be reset to zero and a return to state A.

When the mechanism is in state D, an application of pressure on push-button 24 (P1) causes the second counter to stop, the first also being stopped, which corresponds to state E. Still in state D, an application of pressure on push-button 25 (P2) causes the counters to switch again, the first counter restarting, whereas the second counter stops. The mechanism is then in state F.

If the mechanism is in state E, an application of pressure on push-button 24 (P1) causes the second counter to start again, which corresponds to state D, whereas an application of pressure on push-button 26 (P3) resets the two counters to zero, the mechanism then returning to its initial state A.

When the mechanism is in state F, push-buttons 24 (P1) and 25 (P2) can be actuated, which is comparable to state B. In state F however, the second stopped counter, indicates a measured time, whereas in state B, it was at zero.

Figure 3:
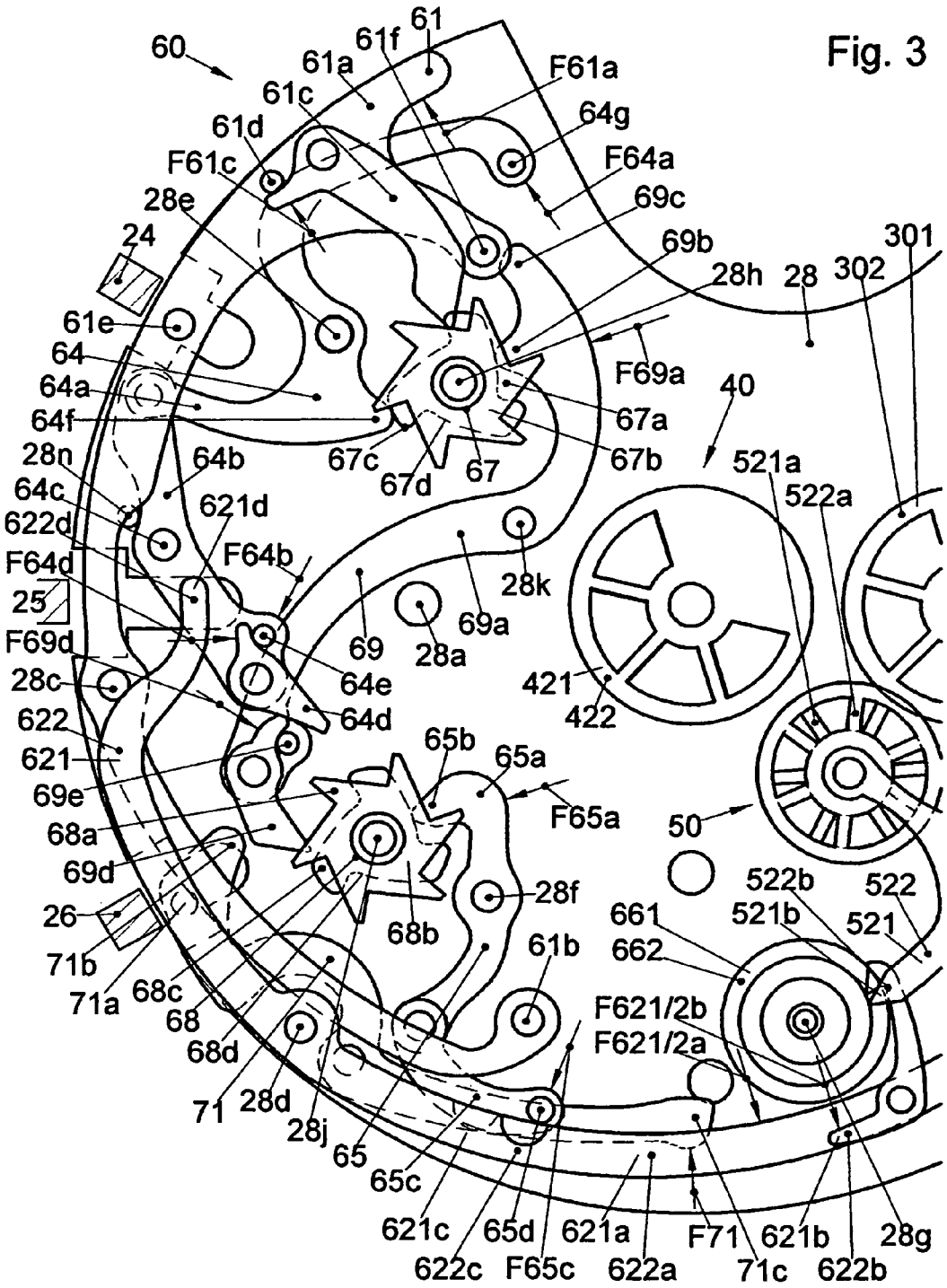
FIGS. 3 to 6 show the mechanism according to the invention, in different positions, corresponding to the main steps encountered during operation.
Figure 4:
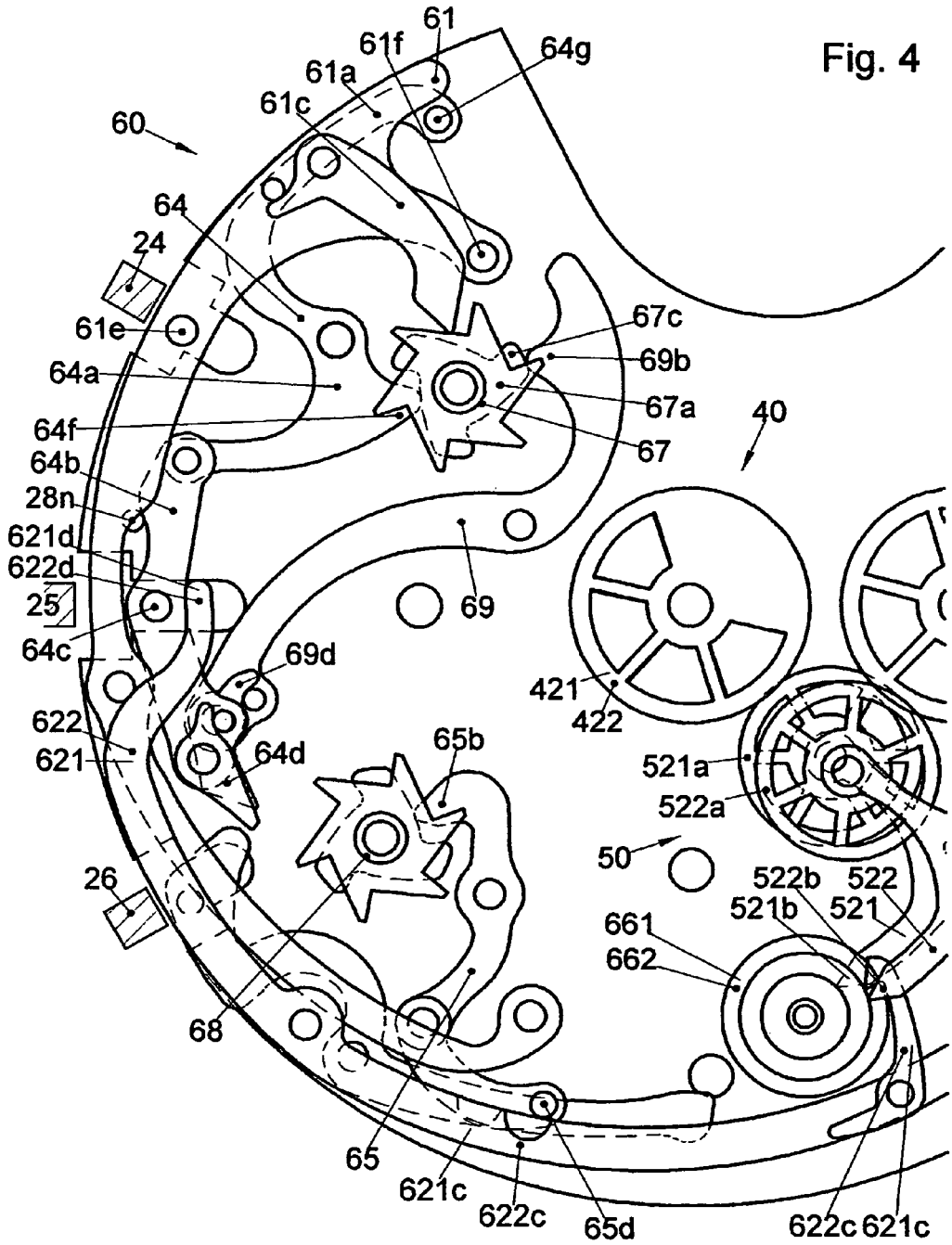

The mechanism assuring these functions is shown in FIGS. 3 to 6. It is arranged on a plate forming a frame 28, part of the base movement and able, for example, to further assure a barrel bridge function. It is on the back cover side of the watch. In FIG. 3, its constituent parts are in state A as defined with reference to FIG. 2, i.e. in the state in which the mechanism is at rest, hands 20 to 22 being at zero. FIG. 4 corresponds to state B, FIG. 5 to state D, and FIG. 6 to state C or D.

In these Figures several parts are superposed. Depending upon whether the part is visible or masked, the line linking the part to its reference numeral includes or does not include a point at the end thereof attached to the part.

Moreover, numerous springs assure the positioning and return of the mobile parts. In order to avoid overloading the drawing, they have been represented by an arrow Fi (i being the reference of the part on which it acts), indicating the direction of force that they generate. The tip of the arrows is applied in proximity to the point of contact. When two identical parts are superposed, the reference of the spring includes an oblique bar followed by the last figure of the reference of the lower part.

In these Figures, push-buttons 24 to 26 are represented schematically by their end, which is arranged inside the case.

The base movement has not been shown. It includes, in a conventional manner, an energy source, a time base, and a going train connecting the energy source to the time base and consequently counting the current time. This train includes a wheel set provided with an arbour passing through frame 28 and carrying two wheels 301 and 302, whose function will be specified hereinafter.

Figure 6:
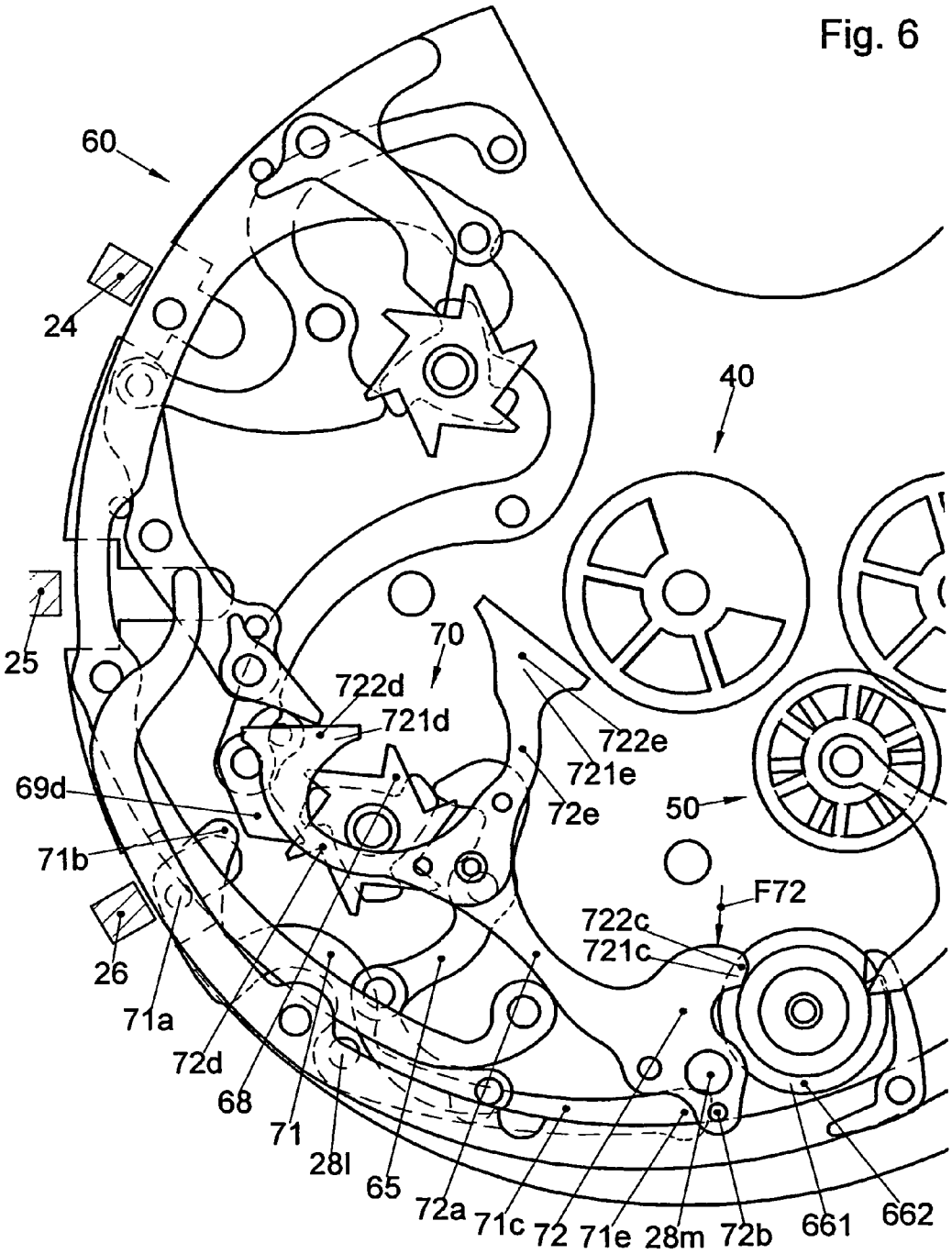

Frame 28 includes: means for counting measured times 40, coupling means 50, actuating means 60, and initialisation means 70, the latter only being visible, in detail, in FIG. 6.

The measured time counting means 40 include two wheels 421 and 422, of the same diameter and provided with the same number of teeth, disposed coaxially to the centre of the movement, and arranged respectively for carrying hands 20 and 21. They also include two coaxial wheels, which have not been shown in the drawing, arranged for pivoting on frame 28 in a hole 28*a*, and respectively driven by wheels 421 and 422, at the rate of one step per minute or half-minute, and arranged such that hands 22 and 23, which they respectively carry, complete one revolution in thirty minutes. These wheels of measured time counting means 40 are each provided with a heart-piece, not shown in the drawing, for cooperating with the initialisation means in order to set the hands to zero.

Coupling means 50 include two levers 521 and 522, mounted so as to pivot on frame 28, in their median part on the same axis, which is outside the scope of the drawing. These levers 521 and 522 carry, at one of their ends, a freely mounted wheel identified by the letter a. They are provided, at the other end, with a nose identified by the letter b for cooperating with actuating means 60, as will be explained hereinafter. Wheels 521*a* and 521*b* are disposed such that they are permanently meshed respectively with wheels 301 and 302 and sequentially with wheels 421 and 422, with reference to the actuating means, as will be specified hereinafter.

In this arrangement, wheel 421 and the first of the wheels pivoting at 28*a* that are not shown together form the first measured time gear train, whereas wheel 422 and the second of the wheels that are not shown form the second measured time gear train. Lever 521, with its wheel 521*a*, form the first coupling clutch and lever 522, with its wheel 522*a*, forms the second.

Actuating means 60 are controlled by push-buttons 24, 25 and 26. They include:

- a start and stop control lever 61 provided with:
  - a body 61*a* pivoting, in its median part, on frame 28 at 28*c*,
  - a control pin 61*b* arranged on body 61*a* at one of its ends,
  - a drive click 61*c*, mounted so as to pivot on body 61*a* at the other end and positioned by a pin 61*d* secured to body 61*a*,
  - a push-button pin 61*e*, arranged facing push-button 24, and
  - a release pin 61*f*;
- superposed coupling-releasing levers 621 and 622, each including a body identified by the letter a and pivoting in its median part at the same point 28*d* of frame 28, and each provided with a click identified by the letter b, for controlling the starting and stopping respectively of the first and second counter, a release cut out portion identified by the letter c and a finger identified by the letter d and extending in proximity to push-button 25;
- a switching lever 64, including:
  - a body 64*a* mounted so as to pivot, in its median part, on the frame at 28*e*,
  - an arm 64*b*, articulated on body 64*a* and carrying a pin 64*c* arranged for cooperating with push-button 25 and fingers 621*d* and 622*d*,
  - a click 64*d*, mounted so as to pivot at the free end of arm 64*b*, positioned by a pin 64*e*, also secured to arm 64*b*,
  - a contact finger 64*f*, disposed on body 64*a* between its pivoting point 28*e* and its end carrying arm 64*b*, and
  - a release pin 64*g* arranged on body 64*a*, at the opposite end to that carrying arm 64*b*;

a selection lever 65, formed of:

a body 65*a* mounted so as to pivot, via its median part, at 28*f* on frame 28, and provided at one of its ends with a nose 65*b*, an arm 65*c* articulated on the other end of body 65*a* and provided at its free end with an activation pin 65*d*;

two coaxial column wheels 661 and 662, mounted so as to pivot on the frame at 28*g*, which each include a ratchet wheel cooperating respectively with clicks 621*b* and 622*b*, and a set of columns respectively cooperating with noses 521*b* and 522*b* (the structure of these wheels has not been shown in detail, since it is well known to those skilled in the art);

two coordination wheels 67 and 68, pivoting respectively at 28*h* and 28*j*, and each including a star-wheel with 6 teeth identified by the letter a and a cam b including three bosses c separated by hollows d, arranged regularly over the periphery of cam b; and an inter-cam lever 69 including a body 69*a* mounted so as to pivot in its median part at 28*k* on frame 28 and including a finger 69*b* abutting against cam 67*b*, an index 69*c* for cooperating with pin 61*f*, the finger and the index being in proximity to wheel 67, whereas the other end, close to wheel 68, includes, mounted so as to pivot, a click 69*d* and a pin 69*e*, secured to body 69*a* and acting as a stop for click 69*d*.

Initialisation means 70 are all visible only in FIG. 6. They include a control lever 71 and a hammer 72, respectively mounted so as to pivot at 281 and 28*m* on frame 28.

Lever 71 carries a pin 71*a*, arranged such that push-button 26 can actuate it. It is provided with a nose 71*b*, required to cooperate with click 69*d*, and an arm 71*c*, forming a stop for hammer 72.

Hammer 72 is formed of a body 72*a*, which carries, in proximity to its pivoting point 28*m*, a pin 72*b* and two superposed noses 721*c* and 722*c*. Pin 72*b* is for cooperating with arm 71*c*, whereas noses 721*c* and 722*c* are arranged for respectively working with the columns of wheels 661 and 662.

The other end of body 72*a* carries two arms 72*d* and 72*e* each provided at its free end with two superposed heels, namely heels 721*d* and 722*d* for arms 72*d*, 721*e* and 722*e* for arm 72*e*. These heels are for cooperating with the heart-pieces with which the wheels carrying hands 20 to 23 are provided.

In the mechanism thus described, the rest position of the various parts of which it is made is, generally, defined by the action of a spring holding each part against a stop. As was explained hereinbefore, these springs are represented simply by an arrow, in order to avoid overloading the drawing.

Thus, as long as no pressure is exerted on push-button 24, lever 61 is held in the position shown in FIG. 3 via the action of a spring F61*a*, schematically represented by an arrow, as explained hereinbefore, abutting against a stop that has not been shown in the drawing. A spring F61*c* holds click 61*c* abutting against pin 61*d*.

Bodies 62*la* and 622*a* of levers 621 and 622 are respectively held in place, against a stop that is not shown, by superposed springs F621*a* and F622*a* designated F621/2*a* in FIG. 3. Clicks 621*b* and 622*b* are respectively biased by springs tending to keep them in contact with the ratchet of column wheels 661 and 662, designated F621/2*b*.

Switching lever 64 abuts via its contact finger 64*f* against cam 67*b*, via the effect of a spring F64*a* acting on its body 64*a*. Arm 64*b* is pressed against a stop secured to frame 28 and schematically represented by a pin 28*n*, via the effect of a spring F64*b*. Click 64*d* is positioned against pin 64*e* by a spring F64*d*.

Selection lever 65 is biased by a spring F65*a*, acting on body 65*a* such that nose 65*b* abuts against cam 68*b*, and a spring F65*c* applying arm 65*c* via pin 65*d* against lever 621 or 622.

In order to hold inter-cam lever 69 abutting via its finger 69*b* against cam 67*c*, its body 69*a* is biased by a spring F69*a*. The position of click 69*d*, abutting against pin 69*e*, is assured by a spring F69*d*.

Lever 71 is controlled by a spring F71, which tends to resist the force applied by push-button 26.

A spring F72*a* is pressed against the body 72*a* such that the heels abut against the heart-pieces when neither the noses nor pin 72*a* are held any longer respectively by arm 71*c* and the columns of wheels 661 and 662 (FIG. 6).

Column wheels 661 and 662 and coordination wheels 67 and 68 are positioned by jumper springs that are not shown in the drawing.

It should be noted that the actuating means described hereinbefore fulfil both a control and switching function. Thus they form a control device, essentially formed by lever 61 and levers 621 and 622, and a switching device essentially formed of switching lever 64 and selection lever 65.

When the device is in state A, as shown in FIG. 3, and pressure is exerted on push-button 24, the latter moves to abut against push-button pin 61*e*, which causes control lever 61 to pivot. In this movement, pin 61*b* enters into contact with arm 65*c*, which is also driven, such that its pin 65*d* is applied against lever 621, which pivots at 28*d*. However, lever 622 remains stationary, since its cut out portion 622*c* is opposite pin 65*d*.

Click 621*b* drives column wheel 661 such that nose 521*b* is located between two columns and lever 521 moves until wheel 521*a* meshes with wheel 421. Thus, the first measured time counter is started. Simultaneously, click 61*c*, cooperating with star-wheel 67*a* drives coordination wheel 67.

Switching and inter-cam levers 64 and 69, abutting against cam 67*b*, also tip to take to position shown in FIG. 4. The tipping of lever 64 brings pin 64*c* into the space swept by push-button 25, thus fulfilling the function of a coupling clutch structure allowing the switching device to be actuated, as will be explained hereinafter. These movements of the levers do not have an immediate effect, all they do is to place the parts such that they can be actuated subsequently, as will be explained hereinafter.

Although only shown in FIG. 6, hammer 72 also pivots when push-button 24 is actuated. Indeed, because of the rotation of column wheel 661, nose 721*c* is raised by a column. Heels 721*d*, 722*d*, 721*e* and 722*e* then release the wheels of the chronograph gear trains, particularly wheels 421 and 422.

It will be noted that, in state A, any action on push-button 25 will not have any effect, since there are no parts cooperating therewith. An application of pressure on push-button 26, however, causes lever 71 to pivot. In this state, hammer 72 is in the initialisation position, i.e. abutting against the heart-pieces comprised in wheels of the chronograph gear train. As will be explained hereinafter, this movement of lever 71 thus has no effect.

Since the mechanism has passed from state A to state B, shown in FIG. 4, it is then possible to actuate push-buttons 24 or 25. Any action on push-button 26, however, has no effect. Hammer 72 is removed from the wheels, and lever 71 is moved away from pin 72*b*, but hammer 72 remains stationary, its nose 722*c* abutting against a column of column wheel 662.

In a similar manner to that described hereinbefore with reference to FIG. 3, actuating push-button 24, in state B, causes lever 61 to move, which causes column wheel 661 and coordination wheel 67 to move through one step. The rotation of column wheel 661 brings nose 521*b* to abut against a column, such that wheel 521*a* is, again, uncoupled from wheel 421.

The mechanism is then in state C, i.e. the first counter is stopped and display the first measured time, whereas the second counter is at zero. In this state, the mechanism occupies the same position as that shown in FIG. 3. There are however two differences between states A and C. On the one hand, the counter for the first measured time is no longer at zero, and on the other hand, hammer 72 is in the wheel release position and not in the initialisation position. These differences do not appear in FIG. 3.

If the user presses push-button 25, the latter will abut against pin 64*c*, which causes arm 64*b* of switching lever 64 to pivot on its body 64*a*.

Pin 64*c* simultaneously pushes levers 621 and 622, abutting against their fingers 621*d* and 622*d*, such that clicks 621*c* and 622*c* respectively drive column wheels 661 and 662 through one step. Lever 521, which was between two columns, moves to abut against one column, whereas lever 522, which was abutting against a column, falls between two columns. Consequently, wheel 521*a* is uncoupled from wheel 421, which interrupts the counting of the first measured time, and wheel 522*a* is coupled with wheel 422, which starts the counting of the second measured time.

With the movement of arm 64*b*, click 64*d* pushes coordination wheel 68 through one step. Since selection lever 65 is abutting against it, via its nose 65*b*, it tips and takes a position such that pin 65*d* is opposite cut out portion 621*c*.

Figure 5:
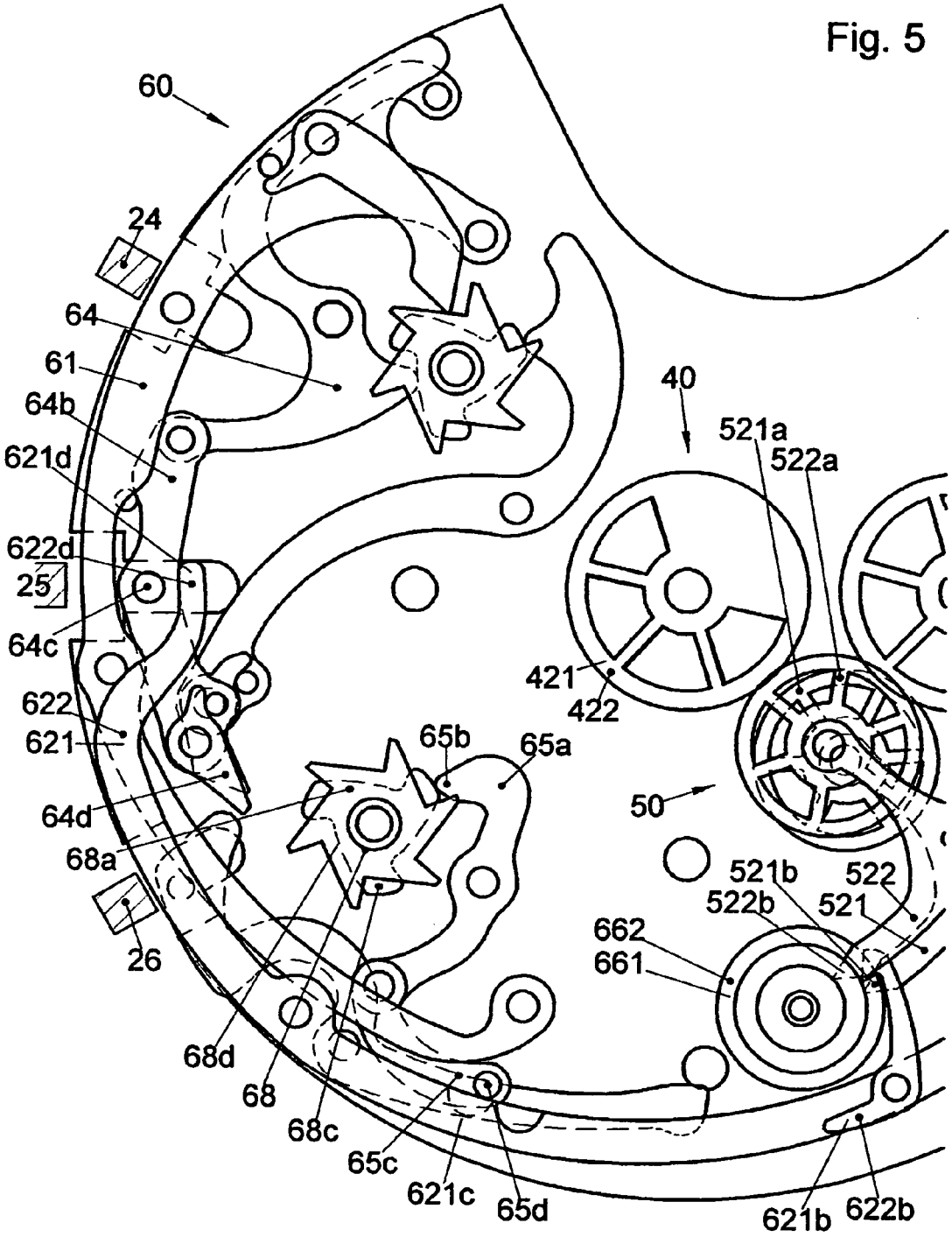

The mechanism has thus passed to state D, which is shown in FIG. 5. In this state, any action on push-button 26 has no effect, but this time, it is column wheel 662 which prevents hammer 72 from tipping.

In state D, it is also possible to actuate push-buttons 24 and 25. In a similar manner to that explained hereinbefore, an application of pressure on push-button 24 causes lever 61 to pivot, which drives arm 65*c*, which is in a position such that its pin 65*d* controls only lever 622. The latter rotates column wheel 622 through one step, such that lever 522*a* abuts against a column and wheel 522*a* and is uncoupled from wheel 422. The second counter, like the first, is thus stopped, which therefore corresponds to state E, in which the parts shown in the drawing occupy the same position as in state C. The only difference lies in the position of hand 21, which displays a time, whereas in state C it is at zero.

When the mechanism is in state D, which is shown in FIG. 5, an application of pressure on push-button 25 again actuates arm 64*b*, and with it the two levers 621 and 622, such that the first counter, which had stopped, starts again, whereas the second counter stops, which corresponds to state F. In other words, as soon as one counter rotates, an application of pressure on push-button 25 causes it to stop and the other to start.

The controls for the mechanism, when it is in state E, are the same as when it is in state C, and in state B when it is in state F. These situations will not therefore be described in more detail.

When the mechanism is in state C or E, it is possible to reinitialise the counters, as can be seen in FIG. 6, by an application of pressure on push-button 26, which abuts against pin 71*a* of lever 71. This causes lever 71 to pivot, such that arm 71*c* no longer holds pin 72*b*. Since the two noses 721*c* and 722*c* are located between two columns of wheels 661 and 662, hammer 72 falls under the force of spring F72, heels 721*d*, 721*e*, 722*d* and 722*e* then drive the cams carried by the wheel sets of the chronograph gear trains, to reinitialise them.

Moreover, nose 71*b* pushes click 69*d*, which drives coordination wheel 68 via its star wheel 68*a* such that selection lever 65 occupies the position where an application of pressure on push-button 24 causes the first measured time counter to start.

It is clear that the mechanism as it has just been described, is only an example embodiment. It is also possible to achieve the same object with variants relying on other components, or the same ones, but having different forms, without thereby departing from the scope of the invention.

It should be noted that the solution described requires less energy than chronograph mechanisms with fly-back hands, while enabling more complex and accurate measurement.

What is claimed is:

1. Chronograph mechanism for cooperating with a movement including:

a frame for carrying the components of the movement, means for counting the current time, including an energy source, a time base and a going train, said mechanism including:

means for counting measured times, coupling means, arranged for engaging and releasing the measured time counting means from the current time counting means, and means for actuating the coupling means characterized in that:

said means for counting measured times include first and second chronograph gear trains, each intended to carry a hand, which respectively assure the display of a first and a second measured time, said coupling means Include first and second coupling clutches, for connecting the going train respectively to the first and the second chronograph gear trains, said actuating means include:

a control device arranged so as to engage or release one coupling clutch or the other, and a switching device arranged such that actuation thereof causes the engaged coupling clutch to be released and the released coupling clutch to be engaged.

2. Mechanism according to claim 1, characterized in that said actuating means further include an initialization device arranged for controlling the resetting to zero of the measured time counting means.

3. Mechanism according to claim 2, characterized in that the switching device includes a coupling structure arranged such that it can only be actuated when one of the chronograph gear trains is coupled.

4. Mechanism according to claim 3, characterized in that the actuating means include a locking structure arranged such that the initialisation device cannot be actuated when one of the chronograph gear trains is coupled.

5. Mechanism according to claim 2, characterized in that the actuating means include a locking structure arranged such that the initialisation device cannot be actuated when one of the chronograph gear trains is coupled.

6. Mechanism according to claim 1, characterized in that the actuating means include a locking structure arranged such that the initialisation device cannot be actuated when one of the chronograph gear trains is coupled.

* * * * *